United States Patent [19]

Sassella

[11] Patent Number: 4,876,864

[45] Date of Patent: Oct. 31, 1989

[54] COMBINATION LOCK

[75] Inventor: Christopher D. Sassella, Lower Plenty, Australia

[73] Assignee: Dowell Australia Limited, Victoria, Australia

[21] Appl. No.: 190,811

[22] Filed: May 6, 1988

[30] Foreign Application Priority Data

May 13, 1987 [AU] Australia ..... PI1892

[51] Int. Cl.[4] ..... E05B 37/02; E05F 11/04

[52] U.S. Cl. ..... 70/89; 49/325; 49/394; 70/93; 70/312

[58] Field of Search ..... 49/325, 394; 70/312, 70/93, 30, 89

[56] References Cited

U.S. PATENT DOCUMENTS

| | | | |
|---|---|---|---|
| 345,270 | 7/1886 | Beggs et al. | 70/322 |
| 1,649,724 | 11/1927 | Olinger | 70/312 |
| 2,118,635 | 5/1938 | Zingman | 70/93 |
| 2,454,794 | 11/1948 | Hakanson | 49/325 |
| 2,660,873 | 12/1953 | Bennett et al. | 70/322 |
| 3,459,016 | 8/1969 | Atkinson | 70/312 |
| 3,633,388 | 1/1972 | Atkinson | 70/321 X |
| 3,667,263 | 6/1972 | Rogers | 70/312 X |
| 3,714,922 | 2/1973 | Da Silva | 70/93 X |

FOREIGN PATENT DOCUMENTS

| | | | |
|---|---|---|---|
| 40336 | 8/1887 | Fed. Rep. of Germany | 70/93 |
| 181139 | 1/1887 | France | 70/93 |

*Primary Examiner*—Lloyd A. Gall

*Attorney, Agent, or Firm*—Foley & Lardner, Schwartz, Jeffrey, Schwaab, Mack, Blumenthal & Evans

[57] ABSTRACT

A combination lock for a panel and a frame is provided. The panel and the frame are such that the panel can move relative to the frame and the combination lock is such that it can lock the panel relative to the frame. The panel has an arm member extending therefrom and the lock releasably prevents the arm member from moving so as to inhibit opening of the panel. In one embodiment the panel can be a swing-out type window. In another embodiment it can be a sliding panel such as a glass door or window.

8 Claims, 6 Drawing Sheets

FIG. 1.
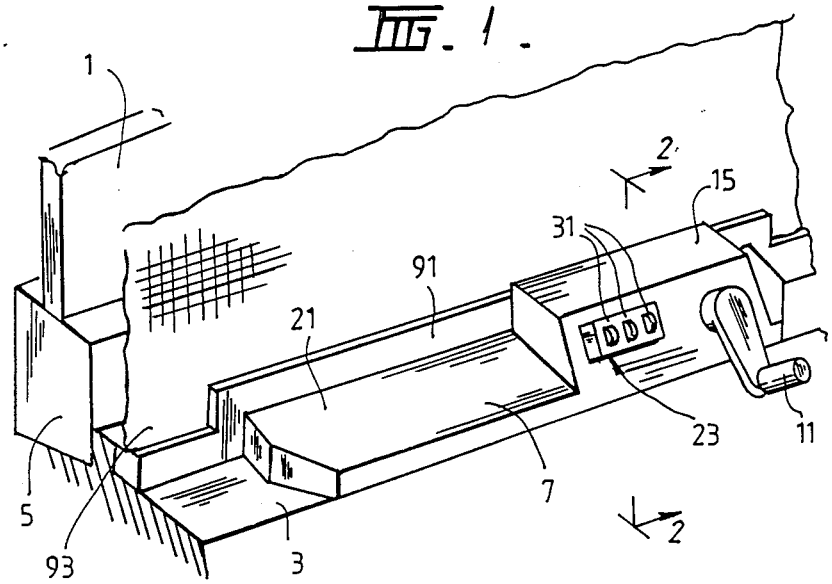
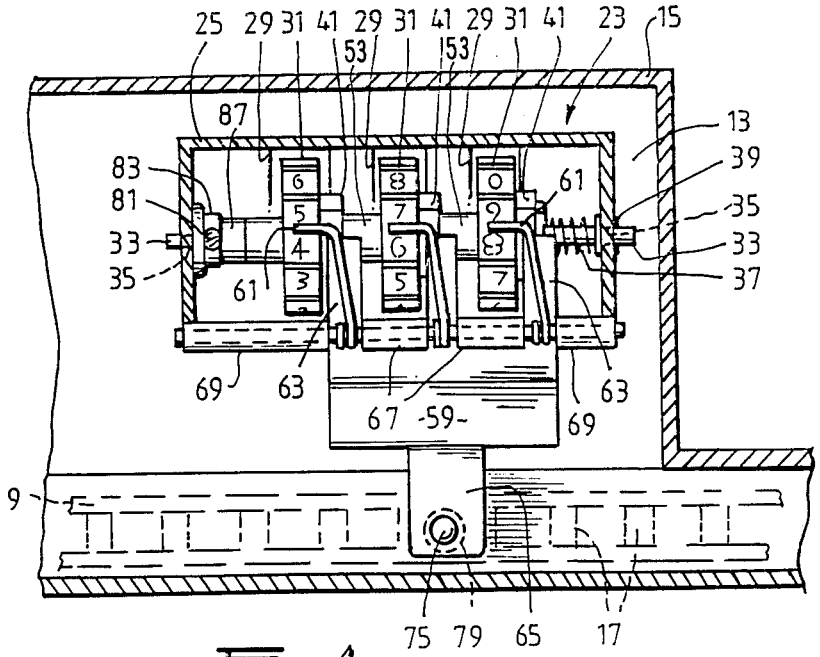
FIG. 4.

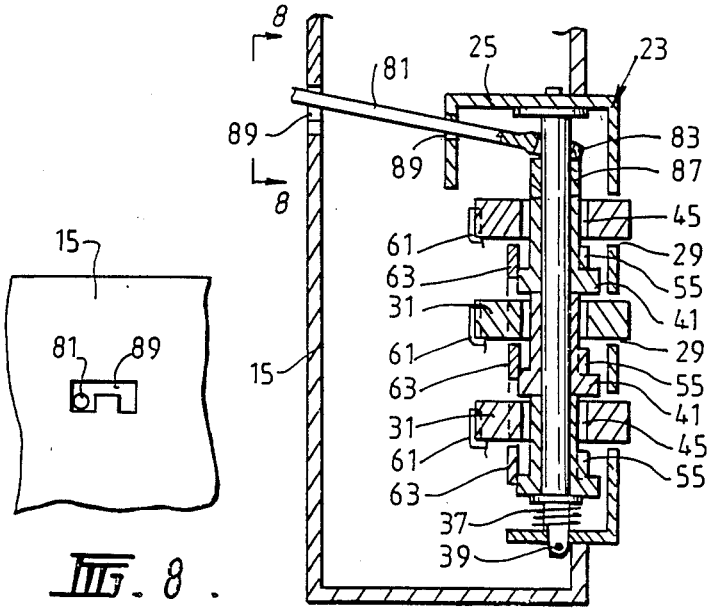
FIG. 8.
FIG. 7.
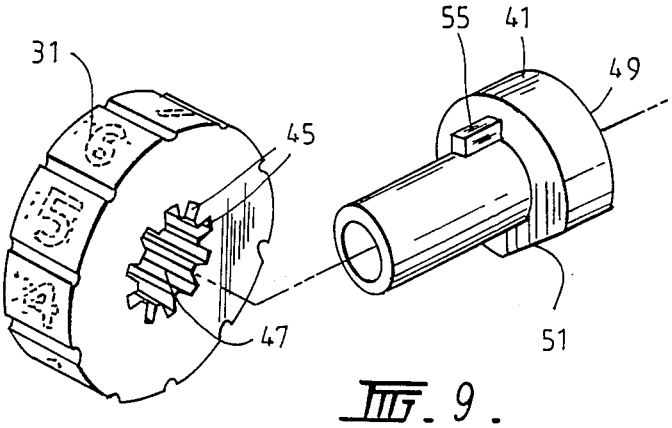
FIG. 9.

COMBINATION LOCK

FIELD OF THE INVENTION

This invention relates to a combination lock member and relates particularly but not exclusively to a combination lock suitable for locking a panel such as a window.

PRIOR ART

Hitherto, in the art of locking windows, it has been common to provide a pin which can be manually inserted through a hole in a window frame and into the window. In a variation of the above it has been known to provide a pin on a lock barrel which is insertable into an opening in a window frame and/or in a window. The lock barrel is key operated and is lockable relative to the window and/or frame by the lock barrel itself. The pin, in turn, projects into the window or the frame to lock the frame and the window together.

STATEMENT OF THE INVENTION

The present invention proposes a combination lock for a window and frame wherein a combination must be achieved before the window can be opened following locking.

The term window is to be considered as being any panel like member such as a window or a door which is to be locked relative to a frame.

Therefore in accordance with a first broad aspect of the present invention there may be provided a combination lock for a panel and a frame assembly where said panel can move relative to said frame, said panel having an arm member extending therefrom which can be used to hold said panel in a closed condition, said combination lock comprising combination locking means and an engaging member operated thereby, said engaging member being for releasably preventing said arm member from moving so as to inhibit opening of said panel.

The arm member which extends from said panel may conveniently comprise a chain of a chain winding mechanism. In a different embodiment said arm member may comprise a locking toggle used in known aluminium sliding windows or doors.

It is particularly preferred that said combination lock comprise at least three thumb wheels with indicia thereon and which need to be set to a desired indicia combination to enable said engaging member to operate to move to a position where said arm member can be released.

In accordance with a further broad aspect of the present invention there may be provided said combination lock fitted to a window and a frame assembly.

BRIEF DESCRIPTION OF THE DRAWINGS

In order that the invention can be more clearly ascertained, examples of preferred embodiments will now be described with reference to the accompanying drawings wherein:

FIG. 1 is a perspective view of a window and frame assembly wherein there is provided a chain winding mechanism for said window;

FIG. 4 is a sectional view along linen 4—4 of FIG. 2;

FIG. 7 is a view similar to FIGS. 3 and 6 but showing how combinatio settings of the thumb wheels can be effected;

FIG. 8 is a view in the direction of arrows 8—8 in FIG. 7;

FIG. 9 is a partly exploded close-up view showing a thumb wheel and a corresponding cam member therefor;

DETAILED DESCRIPTION OF PREFERRED EMBODIMENTS

Figure 2:
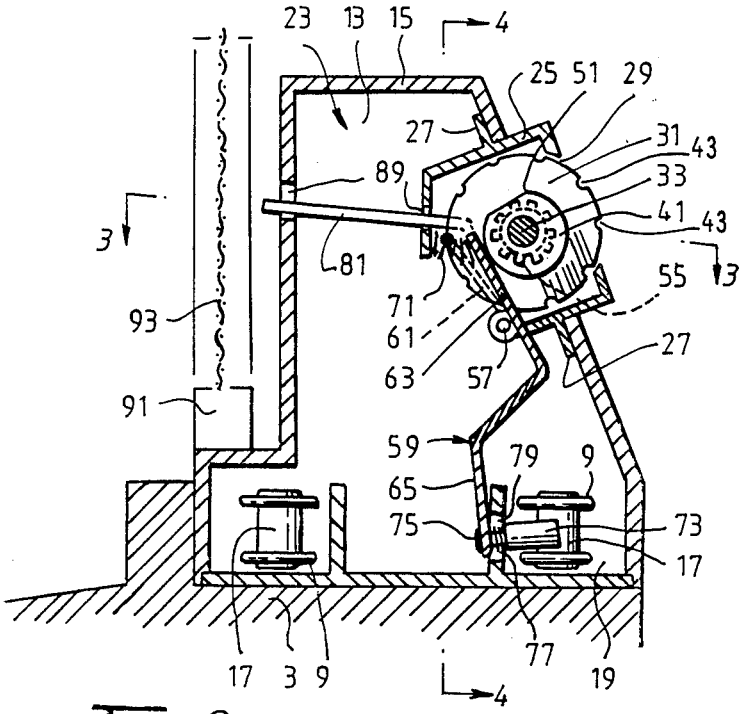
FIG. 2 is a sectional view along line 2—2 of FIG. 1.
Figure 3:
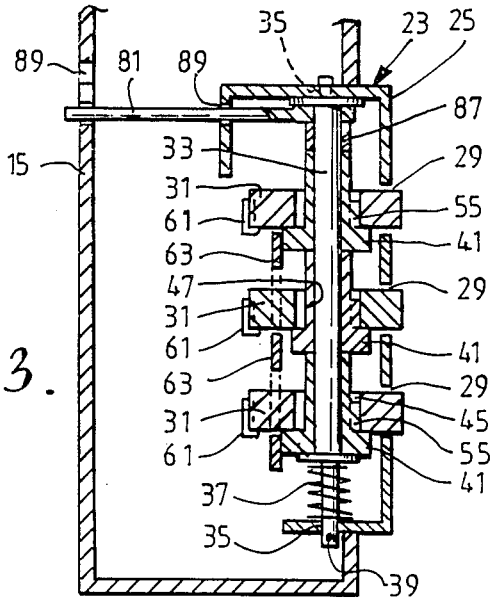
FIG. 3 is a sectional view along line 3—3 of FIG. 2.
Figure 5:
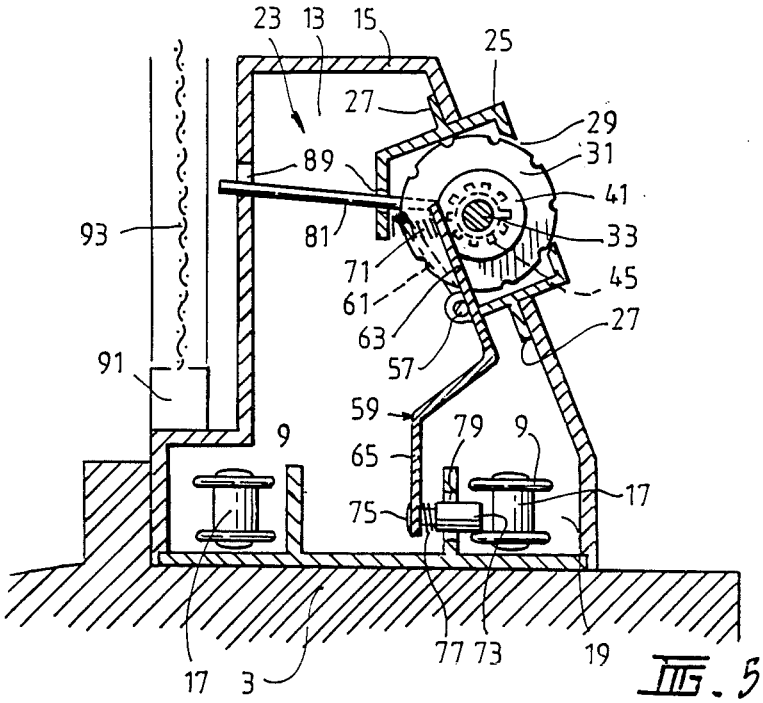
FIG. 5 is a sectional view similar to that of FIG. 2 but showing an engaging member in an unlocked position.
Figure 6:
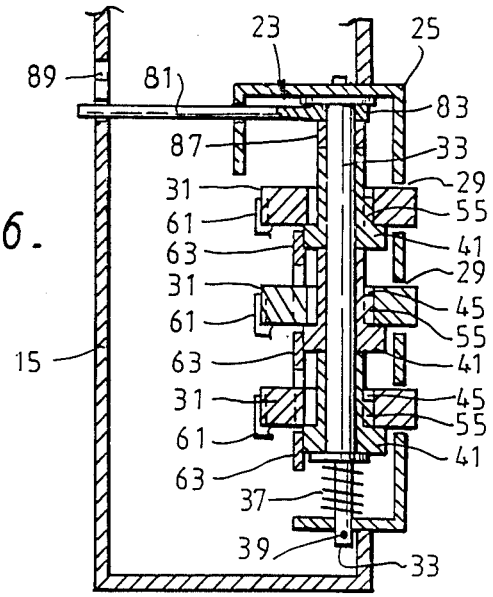
FIG. 6 is a view similar to FIG. 3 showing the engaging member in the unlocked position.

Referring firstly to the embodiments shown in FIGS. 1 through 9, there is shown a window 1 fitted to a window frame 3. The window 1 has its own frame 5. The window 1 and window frame 3 combination is of the swing-out type where the window is hinged at the top of the frame 3. A chain winding mechanism 7 is mounted to the frame 3 for extending the chain or withdrawing the chain to open and close the window 1. The chain of the chain winding mechanism 7 is shown in FIGS. 2 and 5. The window winding mechanism 7 has a handle 11 which has a geared wheel mounted thereon within a cavity 13 of a housing 15 of the chain winding mechanism 7. The geared wheel has not been shown in the drawings. The geared wheel meshes with a further gear wheel (not shown) which has cogs thereon which drivingly engage between pins 17 of the chain 9. Thus as the handle 11 is rotated, the cogged wheel is rotated which, in turn, causes the chain 9 to be extended or retracted. The chain 9 travels within the housing 15 along a generally U-shaped track 19 which extends from the housing end n15 into the side section 21 of the chain winding mechanism 7. The chain 9 can be extended or retracted in a direction generally perpendicular to the longitudinal extent of the chain windding mechanism 7 from the rear of the chain winding mechanism 7 shown in FIG. 1. Thus, the window 1 can be made to swing outwardly or swing inwardly depending on the direction of rotation of the handle 11. The chain winding mechanism, so far described, can be regarded as prior art.

The chain 9 can therefore be considered as an arm member which extends from the window 1.

Mounted within the housinig 15 and alongside the handle 11 is a combination locking means 23. The combination locking means 23 has its own housing 25 which may be conveniently formed from a suitable die casting material. The housing 25 is generally of elongate box-like construction and has flange members 27 thereon (see FIG. 2) which facilitates mounting relative to the housing 15. The front face of othe housing 25 has three spaced apart apertures 29 through which part of respective thumb wheels 31 pass. The thumb wheels 31 are mounted for rotation on a spindle 33 which is, in turn, mounted for rotation within openings 35 at each end of the housing 25. This will e described in detail in due course. A spring member 37 biases the spindle 33 to one side of the housing 25. A pin 39 which passes through one end of the spindle 33 limits the movement of the spindle 33 i nthe direction of the forces applied by the spring member 37.

The spindle 33 carries three cam members 41. The cam members 41 are identical. FIG. 9 shows the arrangement of a thumb wheel 31 and a cam member 41 therefor. It can be seen that the thumb wheel 31 has indicia markings on a circumferential face thereof. In the preferred embodiment there are ten indicia markings in the form of numbers 0—9. There are ten click-stop grooves 43 equally spaced around the circumferential side surface. The thumb wheels 31 have a series of tooth-shaped cutouts 45 extending radially outwardly from a central opening 47. The tooth-shaped cutouts 45 are angularly aligned with the respective indexing grooves 43. Each cam member 41 has a cam surface 49 with a flat 51 thereon. They each also have a cylindrical sleeve portion 53 extending from one side of the cam s urface 49. An indexing tongue 55 extendsd radially outwardly from the sleeve 53 and has a length along the longitudinal extent of the sleeve 53 sufficient to lock within a respective one of the tooth-shaped cutouts 45. The length of the indexing tongue 55 is important and will be explained in due course.

FIGS. 2 and 5 show that a lowermost end of the housing 25 carries a pin 57 which passes through openings (not shown) on each of the endds of the housing 25. The pin 57 serves as an axle for swinging of an engaging member 59. It also serves as a fulcrum point for three indexing spring means 61 which locates in respective ones of the indexing grooves 43 as the thumb wheels 31 are rotated. Each indexing spring means 61 conveniently comprises a spring as of piano wire or other suitable material which can be held relative to the pin 57 and pass across a face of a respective one of the thumb wheels 31 and locate within a respective one of the indexing grooves 43. The three indexing spring means 61 are shown clearly in FIG. 4.

As shown in FIG. 4, the engaging member 59 has three upstanding fingers 63 which are arranged to respectively engage with a cam surface 49 of each of the respective cam members 41. It also has downwardly depending arm 65. The engaging member 59 is conveniently fabricated from sheet steel and has rolled portions 67 through which the pin 57 can pass. The housing 25 has similar portions 69 through which the pin 57 can pass. Thus, the pin 57 can be held relative to the housing 25. The engaging member 59 can then be held relative to the pin 57 so that it can swing about the central axis thereof. A spring member 71 (see FIG. 2 and FIG. 5) engages with an inside portion of the housing 25 and with an upper end of a central one of the fingers 63 to cause the engaging member 59 to be biased under spring pressure towards the cam members 41 and onto the cam surface 49.

The lowermost end of the arm 65 carries a pin 73 which is held relative to the engaging member 59 by a head 75 thereof passing through an opening in the arm 65 and by a light spring 77 urging it in an outwardly extended position so that the head 75 engages with the arm 65. The pin 73 is able to move a limited distance against the spring bias, through the opening. Accordingly, if in use, the engaging member 59 should swing so that the pin 73 engages with pin 17 of the chain 9 then the pin 73 can be displaced relative to the engaging member 59 until correct indexing of the pin 73 is obtained relative to pin 17 of the chain 9.

Thus, under normal locking conditions for the chain winding mechanism 7, the pin 73 is to locate between pins 17 of the chain 9. It can be seen that the pin 73 passes through an opening 79 in a side wall of the track 19 in which the chain 9 moves.

The angular orientation of the cam members 41 on spindle 33 determines whether the engaging member 59 is moved to effect locking or unlocking of the chaian 9 (the arm member which extends from the window 1). In order for the engaging member 59 to be in an unlocked condition to enable the chain 9 to be extended or retracted, then the flats 51 on the respective cam members 41 need to be engaged with the face of the engaging member 59 which rides on the cam surface 49. If any one of the flats 51 is not in this orientation, then the engaging member 59 will be retained in the chain locking position.

In order that the combination locking means 23 can be set to a desired combination, there is provided a setting lever 81. The setting lever 81 comprises a metal rod with an enlarged head 83 which has an aperture therein and through which the spindle 33 passes. One side face of the head 83 is, in use, engaged with a sleeve 87 slidably fitted on the spindle 33. The setting lever 81 passes through a gate 89 in the housing 25. The gate 89 acts as a fulcrum point for movement of the lever 81. The lever also passes through the housing 15 through a gate 89. The gate 89 is clearly shown in FIG. 8. In FIG. 8 the lever 81 is shown in a position where the combination of the combination locking means 23 can be reset. In this position the lever 81 causes displacement of the cam members 41 as shown in FIG. 7. In this operated condition, the sleeve 87 has pushed on the adjacent cam member 41 which, in turn, has pushed on the next adjacent cam member 41 which, in turn, has pushed on the next adjacent cam member 41 thus causing all the cam members 41 to slide along the spindle 33, and the respective indexing tongues 55 to disengage from the respective tooth-shaped cutouts 45 in the thumb wheels 31. The thumb wheels 31 are inhibited from sideways displacement during such movement of the setting lever 81 by the side surfaces thereof engaging with the side surfaces of the apertures 29. The length of the tongues 55 is sufficient to permit the tongues 55 to completely disengage relative to the tooth-shaped cutouts 45. In other words, the length of the indexing tongues 55 is equal to the displacement of the cam members 41 along the spindle 33 but is shorter than the length of sleeve portion 53 which is retained within central openings 47 in the thumb wheels 31.

When the cam members 41 are displaced in the manner described above, then the thumb wheels 31 can be rotated to a desired combination. When the desired combination has been selected, then the setting lever 81 can be moved through the gate 89 to the other side thereof, thus returning the tongues 55 of the cam members 41 into drive engagement with the thumb wheels 31. During this motion the indexing tongues 55 locate in the appropriate tooth-shaped cutouts 45 for the combination set by the user.

It should be appreciated therefore, that the combination locking means 23 described above, permits a user to select a desired combination for locking and unlocking of the arm emmber—the chain 9—which extends from the window. The arrangement is such that a user can select any desired combination to permit unlocking.

It should also be observed that the setting lever 81 protrudes from a rear surface of the housing 15 and, in use, is normally covered by a frame 91 of a fly screen 93. Thus, it is not possible for an intruder to gain access to the setting lever 81 to reset the combination locking menas 23 to a combination which he knows and which will permit opening of the window 1.

It should be observed that the indexing spring means 61 will provide positive stopping of the rotation of the thumb wheels 31 at desired settings and will also act as a means to inhibit a person from "feeling" the lock and possibly ascertaining the set combination. This is because each time the thumb wheels 31 index relative to the indexing spring means 61 there is a positive locking stopping of the thumb wheels 31. This will, in turn, inhibit an intruder from feeling when the flats 51 on the cam members 41 are in line with the fingers 63 of the engaging member 59.

It should be appreciated that the locking means 23 can be used to lock the window 1 in any desired open position as determined by the setting of chain 9.

Figure 10:
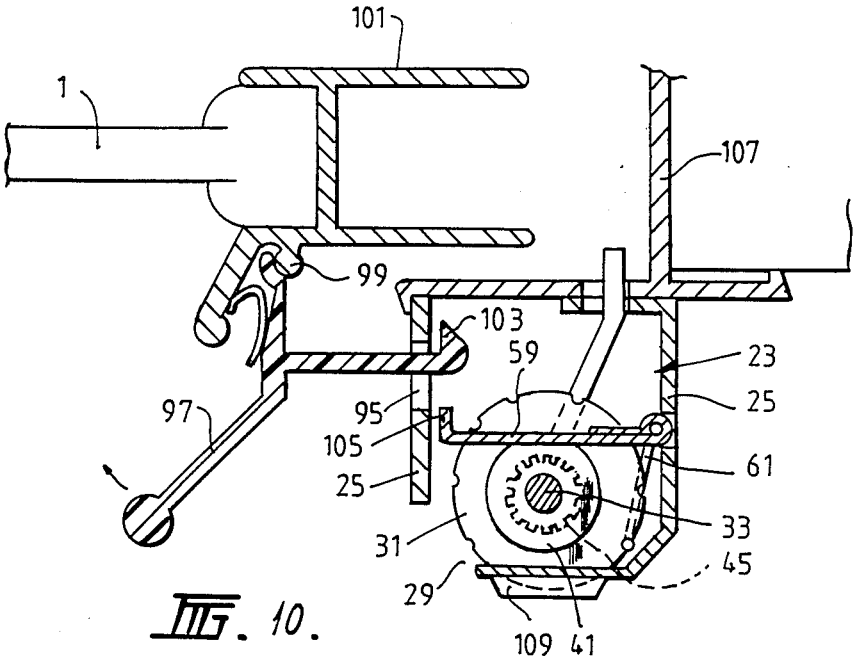
FIG. 10 is a sectional view of a combination lock mechanism similar to that shown in FIGS. 1 through 9 but for use in connection with sliding aluminium window and frame assemblies.
Figure 11:
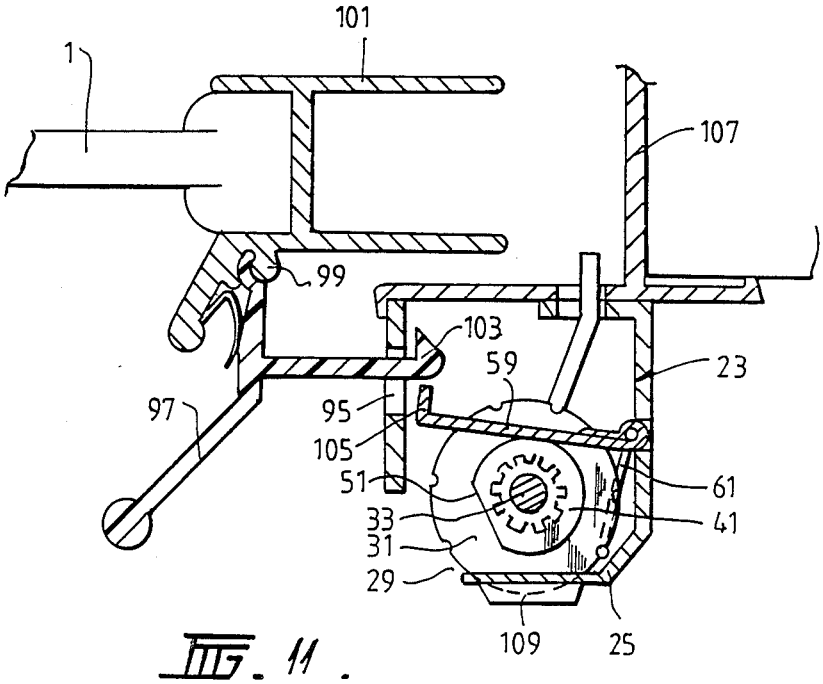
FIG. 11 is a view similar to that of FIG. 10 but showing an engaging member in a locked condition and abutting with an arm member extending from the window.

Referring now to the embodiments shown in FIGS. 10 and 11, there is shown a modification of the combination locking means described in the previous embodiment to enable it to act on sliding aluminium frame windows and/or sliding aluminium frame doors. The combination locking means 23 is substantially identical to the locking means 23 shown in the previous embodiment except that the engaging member 59 is different in shape and function, and there is an opening 95 in the housing 25 through which an arm member which extends from the window 1 can pass. The arm member is here shown as arm member 97 and conveniently comprises a plastics material toggle of known construction for use with sliding windows and/or sliding doors. The arm member 97 or toggle can swing about a rotational axis defined by rib 99 forming part of a frame 101 of the window 1. The arm member 97 or toggle has a head 103 which can locate on the inside surface of the housing 25 adjacent the opening 95 to lock the window in a closed position. The engaging member 59 is arranged with a depending web 105 which will engage with the head 103 to inhibit the arm member 97 or toggle from swingingn so that the head 103 can pass through the opening 95.

FIG. 10 shows the engaging member 59 in a position where the arm member 97 or toggle can be moved to permit releasing of the head 103 and thus opening of the window 1.

FIG. 11 shows the engaging member 59 engaged with the head 103 so as to inhibit swinging of the arm member 97 or toggle. Thus, the window 1 is held in a locked condition.

Typically, the housing 25 can be fastened to the frame 107 of the window.

FIGS. 10 and 11 also show that the opening 29 for the thumb wheels 31 is somewhat differenttly shaped to that in the previous embodiment. A lens 109 is shown mounted to the housing 25 so that the indicia on the thumb wheels 31 can be magnified and easily seen by a user. A similar lens arrangement can be employed in the previous embodiment if desired.

Figure 12:
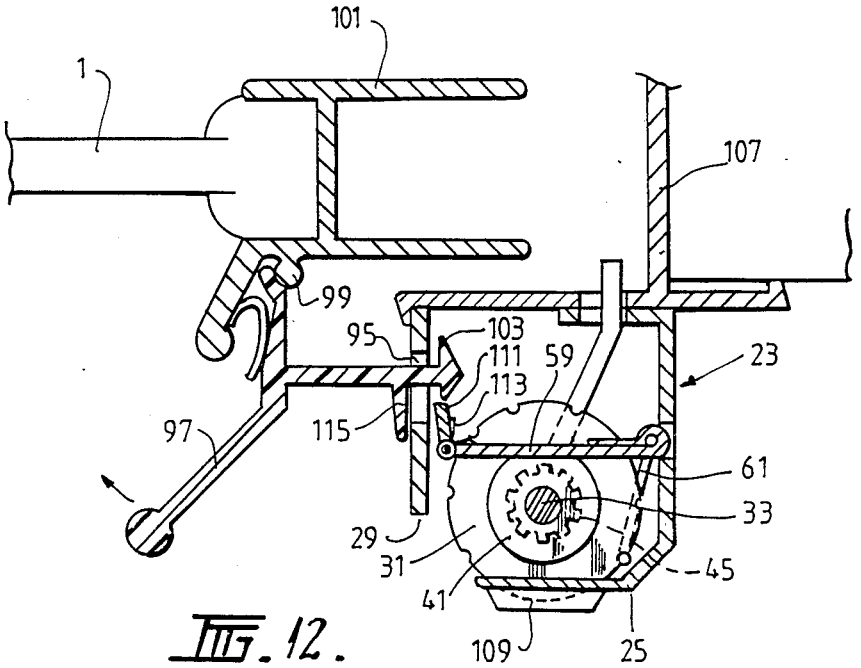
FIG. 12 is a view similar to FIG. 10 showing a modification of the embodiments shown in FIG. 10.
Figure 13:
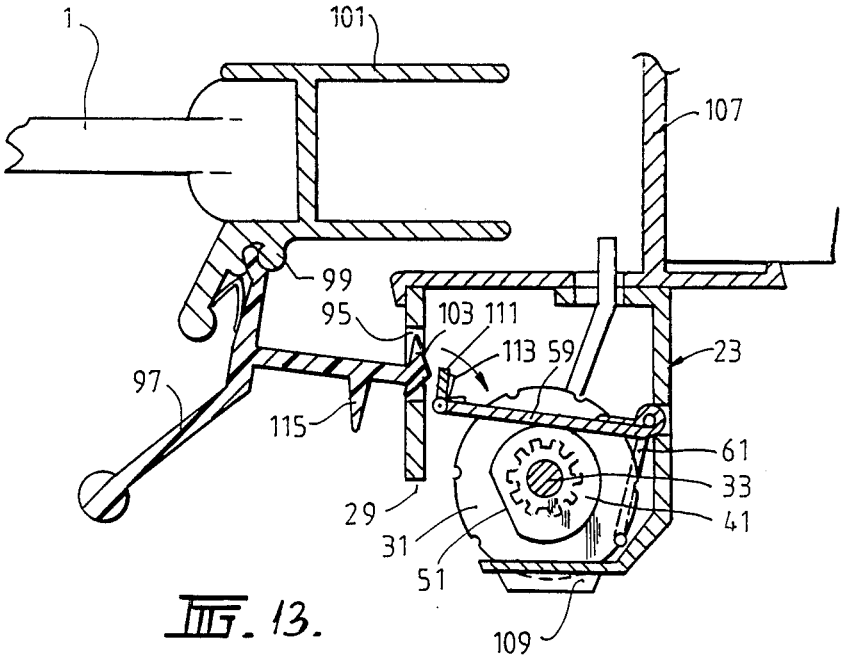
FIG. 13 is a view similar to FIG. 11 showing the embodiment of FIG. 12.

FIGS. 12 and 13 show an embodiment where the engaging member 59 is provided with a swingable web 11. The web 11 is similar to the web 105 in the previous embodiment except that it can swing in a clockwise direction as shown by the arrow. FIG. 13 shows the combination lock set to a position where the engaging member 59 partly overlaps the opening 95 and thus the former web 105 would be inhibiting the head 103, of the former embodiment from passing through the opening 95 and engaging on the inside surface of the housing 25. Thus, the web 111 can swing to allow the head 103 to pass. Spring means 113 are carried on the engaging member 59 to bias the web 111 to the position shown in FIG. 12. It cana be seen that the head 103 is provided with a barb shaped configuration so that the web 111 can locate behind the barb. The arm member 97 can be provided with an upstanding web 115 which will cover the opening 95 so that when the window or door is locked, a person cannot push any object in the opening 95 to attempt to swing the web 111 to permit releasing of the head 103 from engagement with the inside of the housing 25.

With the embodiments shown it can be seen that a combination lock is provided for a window and frame assembly. The arrangement is such that the combination lock can be easily adjusted by a user to set a desired combination. The construction is relatively simple and does not unduly complicate the necessary mechanism for locking and/or unlocking the window 1. In this connection the combination lock for use with a chain winding mechanism 7 does not require enlargement of an existing die casting from which the housing 15 and side section 21 is made. The only requirement is to provide an opening for the housing 25 of the combination locking means 23.

Many modifications may be made to the present invention as would be apparent to persons skilled in the locking arts. For example, the thumb wheels may be made from a suitable plastics material instead of from metal. Similarly, the housing 25 can be made from a suitable plastics materials if desired. In addition, instead of providing a housing 25 which is attached to an existing housing 15, the housing 25 can be moulded integral with the housing 15. These and other modifications may be made without departing from the ambit of the invention, the nature of which is to be determined from the foregoing description.

I claim:

1. A combination lock for a panel and a frame assembly where said panel can move relative to said frame, said panel having a chain winding mechanism and an arm member extending therefrom which can be used to hold said panel in a closed condition, said combination lock comprising combination locking means and an engaging member operated thereby, said engaging member being for releasably preventing said arm member from moving so as to inhibit opening of said panel, said arm member being a chain of said chain winding mechanism for a swing-out window and said combination lock being fitted within a housing of said chain winding mechanism, said engaging member being movable into engagement with said chain within said housing for releasably preventing said chain from moving so as to inhibit opening of said panel.

2. A combination lock as claimed in claim 1, wherein said engaging member has a pin thereon and wherein said chain has links held to each other with pins and wherein said pin on said engaging member can locate between adjacent pins nto inhibit opening of said panel.

3. A combination lock as claimed in claim 1, wherein said pin is spring biased into an extended position and wherein if said pin should engage with, instead of between, adjacent pins in said chain, it can be displaced under spriing bias and caused to locate between said adjacent pins if the chain is moved.

4. A combination lock as claimed in claim 1, wherein said combination lock includes cam members which include cam surfaces which must be aligned in order to permit movement of said engaging member to permit said arm member to move to enable opening of said panel.

5. A combination lock as claimed in claim 4, wherein said cam members have flats thereon which must be aligned and engaged with said engaging member to permit said arm member to move to enable opening of said panel.

6. A combination lock as claimed in claim 4, wherein said engaging member is able to swing about a pivot intermediate its length and wherein said cm members engage with one end of said engaging member, a pin at the other end of said engaging member, and wherein said chain has links held to each other with pins, said pin on said engaging member being capable of positioning between adjacent pins of said chain links to inhibit opening of said panel.

7. A combination lock as claimed in claim 6, wherein said engaging member is spring biased to engage said icam members.

8. A combination lock as claimed in claim 1, wherein a setting lever for said combination lock extends from a face of said housing which, in use, is directed to face said panel so that it will be covered when said panel is closed thereby inhibiting said setting lever from being operated until said panel is open.

* * * * *